US005517710A

United States Patent [19]

Hisey

[11] Patent Number: 5,517,710

[45] Date of Patent: May 21, 1996

[54] MULTI-PURPOSE BROOM

[76] Inventor: Christopher B. Hisey, 303 Oakwood Dr., P.O. Box 166, Francis Creek, Wis. 54214

[21] Appl. No.: 274,984

[22] Filed: Jul. 13, 1994

[51] Int. Cl.[6] ..... A46B 5/00

[52] U.S. Cl. ..... 15/106; 15/160; 15/172; 15/176.1; 15/202

[58] Field of Search ..... 15/106, 159.1, 15/160, 171, 172, 176.1–176.6, 202, 107, 105, 111, 113, 114, 115, 117, 118, 121

[56] References Cited

U.S. PATENT DOCUMENTS

| | | | |
|---|---|---|---|
| D. 104,029 | 4/1937 | Gray | 15/160 |
| 183,557 | 10/1876 | Goldsmith | 15/107 |
| 1,183,528 | 5/1916 | Bongiovanni | 15/105 |
| 1,994,939 | 3/1935 | Boulton | 15/121 |
| 2,171,444 | 8/1939 | Frank | 15/160 |
| 2,254,160 | 8/1941 | Spyckaboer | 15/106 |
| 2,648,082 | 8/1953 | Teetsel | 15/106 |
| 2,671,918 | 3/1954 | Jones | 15/106 |
| 2,713,177 | 7/1955 | Pisapia | 15/202 |
| 2,715,237 | 8/1955 | Trinol | 15/115 |
| 3,134,129 | 5/1964 | Allen | 15/202 |
| 3,451,092 | 6/1969 | Szopo | 15/106 |
| 3,564,638 | 2/1971 | Buchholtz | 15/172 |
| 5,123,138 | 6/1992 | Flamm | 15/111 |

FOREIGN PATENT DOCUMENTS

| | | | |
|---|---|---|---|
| 499315 | 3/1951 | Belgium | 15/115 |
| 64745 | 6/1955 | France | 15/106 |
| 1387220 | 12/1963 | France | 15/202 |
| 2224113 | 10/1974 | France | 15/202 |
| 132547 | 7/1902 | Germany | 15/111 |
| 193042 | 12/1907 | Germany | 15/106 |
| 532338 | 11/1928 | Germany | 15/114 |
| 100995 | 12/1962 | Norway | 15/106 |
| 181502 | 3/1936 | Switzerland | 15/106 |
| 880 | 1/1886 | United Kingdom | 15/106 |
| 11681 | 8/1887 | United Kingdom | 15/160 |
| 6320 | 3/1893 | United Kingdom | 15/106 |
| 10902 | 3/1899 | United Kingdom | 15/176.3 |
| 493802 | 10/1938 | United Kingdom | 15/176.3 |

*Primary Examiner*—Mark Spisich
*Attorney, Agent, or Firm*—Saidman Design Law Group

[57] ABSTRACT

A multi-purpose broom which can be used in any of three distinct modes: as a conventional broom; as a broom that can reach and clean normally inaccessible horizontal surfaces (e.g., the top surface of a blade of a ceiling fan); and as a hand-held sweeper.

9 Claims, 4 Drawing Sheets

MULTI-PURPOSE BROOM

BACKGROUND OF THE INVENTION

1. Field of the Invention

This invention relates to a broom and, more particularly, is directed towards a broom which may be used in one of three distinct ways.

2. Description of Related Art

Brooms have been around for a long time, and are well known. Conventionally, brooms are designed with a bristle portion to permit the user to sweep, for example, a floor.

Frequently, however, it is necessary to sweep areas which are not underfoot or readily accessible. For example, if one wanted to sweep the cobwebs from a comer of a ceiling, one would normally simply extend the broom upwardly and use the inverted bristles to sweep the ceiling corner clean.

However, a more difficult situation occurs when the dirty surface comprises, for example, the top ledge of a door, or the top surface of a blade of a ceiling fan. It may be appreciated that such surfaces are not readily accessible when using a conventional broom, even if the broom is turned upside down. This is due, in part, to the fact that the bristles of the broom, when inverted, extend in the wrong direction to clean such surfaces.

I am not aware of any specialty brooms currently on the market for cleaning such surfaces (e.g., the top surfaces of ceiling fan blades). It would be highly desirable if such a broom could be provided that would permit cleaning of such normally inaccessible surfaces without having to climb a ladder or the like.

It would also be highly desirable if such a broom could be provided which could be used either as a conventional broom or as a broom to clean such normally inaccessible surfaces.

Hand-held sweepers, normally used with dustpans, are also quite popular. However, such hand-held sweepers comprise yet another piece of cleaning equipment which must be purchased, stored, and cleaned, just to be used on occasion when the situation warrants. It would therefore be highly desirable if such a hand-held sweeper could be provided in some way other than as a separate piece of equipment, in order to minimize cost and maximize efficiency.

It is towards these ends that the present invention is advanced.

OBJECTS AND SUMMARY OF THE INVENTION

It is therefore a primary object of the present invention to provide a broom which can either be used as a conventional broom or as a broom for cleaning normally inaccessible horizontal surfaces.

Another object of the present invention is to provide a broom which can be used conventionally, and which includes a portion that may be detached and used as a hand-held sweeper.

Still another object of the present invention is to provide a multi-purpose broom which can be used either conventionally (e.g., to sweep a floor), or to clean upper, normally inaccessible surfaces (e.g., the top surface of a ceiling fan blade), or a portion of which may be detached and used as a hand-held sweeper.

A still further object of the present invention is to provide a multi-purpose broom which is inexpensive to manufacture, easy to use, and which replaces the necessity for having a plurality of different brooms for different purposes.

The foregoing and other objects are achieved in accordance with one aspect of the present invention through the provision of a broom which comprises a first portion comprising a first base member and a first set of bristles extending from the first base member, and a second portion comprising a second base member and a second set of bristles extending from the second base member. A handle is preferably connected to the first base member, and the second portion is preferably selectively attachable to and removable from the first portion.

In accordance with another aspect of the present invention, the second base member includes a hand grip portion to permit the second portion to be used as a hand sweeper, independently of the first portion. The hand grip portion preferably comprises an upper portion, a lower portion, and a side portion connecting the upper portion and lower portion. The upper, lower and side portions preferably combine to form an opening to permit a user to grip same. The hand grip portion may further comprise a second side portion connecting the upper portion and the lower portion whereby the opening is a closed loop.

In accordance with another aspect of the present invention, the first portion and second portion further preferably include coupling means for permitting the second portion to be mounted to the first portion in either a conventional position or an inverted position. The conventional position is defined by the first and second set of bristles being directed in the same direction, and may further be defined by the first and second set of bristles being adjacent one another. The inverted position is defined by the first and second set of bristles being directed in opposite directions. More specifically, the coupling means preferably comprises means formed in the first and second base members for permitting the second base member to be slidably inserted in and removed from the first base member.

In accordance with yet another aspect of the present invention, there is provided a broom which comprises a first portion having a first set of bristles extending therefrom, a second portion having a second set of bristles extending therefrom, and a handle connected to the first portion, the second portion being selectively attachable to the first portion in either a conventional position or an inverted position.

In accordance with yet another aspect of the present invention, a broom is provided which comprises a first portion comprising a first base member and a first set of bristles extending from the first base member in a first direction, a second portion comprising a second base member and a second set of bristles extending from the second base member in a second direction different from the first direction, and a handle connected to the first base member.

More particularly, the second direction is preferably 180 degrees opposite to the first direction, and the handle extends from the base member in substantially the same direction as the second direction.

BRIEF DESCRIPTION OF THE DRAWINGS

The foregoing and other objects, aspects and features of the present invention will be more fully appreciated as the same becomes better understood when considered in connection with the following detailed description of the present invention viewed in conjunction with the accompanying drawings, in which.

DETAILED DESCRIPTION OF THE PREFERRED EMBODIMENTS

Figure 1:
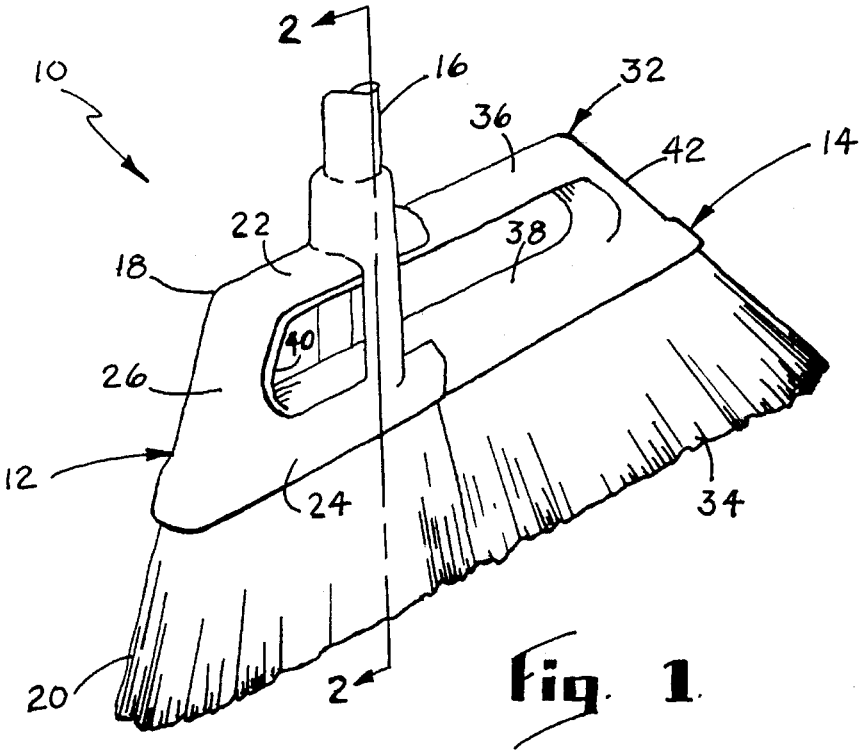
FIG. 1 is a perspective view of a preferred embodiment of the present invention.
Figure 2:
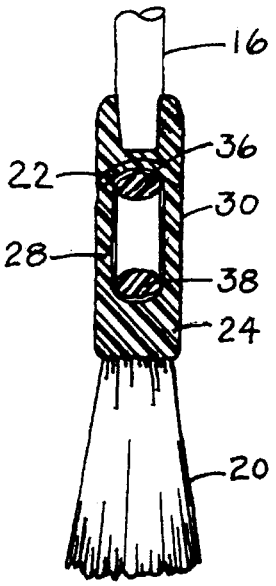
FIG. 2 is a sectional view taken along line 2—2 of FIG. 1.

Referring now to the drawings, wherein like reference numerals represent identical or corresponding parts throughout the several views, and more particularly to FIG. 1 thereof, reference numeral 10 indicates generally a preferred embodiment of the multi-purpose broom of the present invention.

Broom 10 comprises a first portion indicated generally by reference numeral 12, and a second portion indicated generally by reference numeral 14. Second portion 14 is selectively attachable to and removable from first portion 12, in a manner which will be described in greater detail hereinafter.

Integrally connected to first portion 12 is a handle 16 which preferably lies in the same plane as first and second portions 12 and 14.

Figure 3:
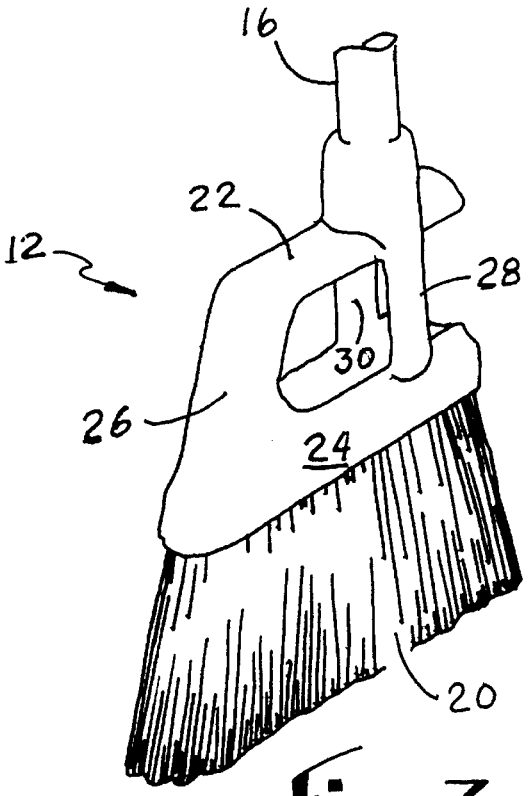
FIG. 3 is a perspective view of a first portion of the present invention.

As seen in FIGS. 1 and 3, first portion 12 comprises a base member 18 which is somewhat C-shaped and is preferably formed of plastic. Coupled to base member 18 and extending downwardly therefrom (as viewed in FIGS. 1 and 3) is a cleaning element such as a first set of broom bristles 20 which are of conventional composition.

Base member 18 includes a top portion 22, a bottom portion 24, and a side portion 26 which connects the ends of the top and bottom portions 22 and 24. Top and bottom portions 22 and 24 include inner surfaces of the same size, shape, and curvature, for a purpose that will become more clear hereinafter.

Handle 16 in the preferred embodiment preferably includes bifurcated portions 28 and 30 that permit handle 16 to be mounted perpendicularly to base member 18 so that broom 10 may be used with equal facility from the left or right.

Figure 4:
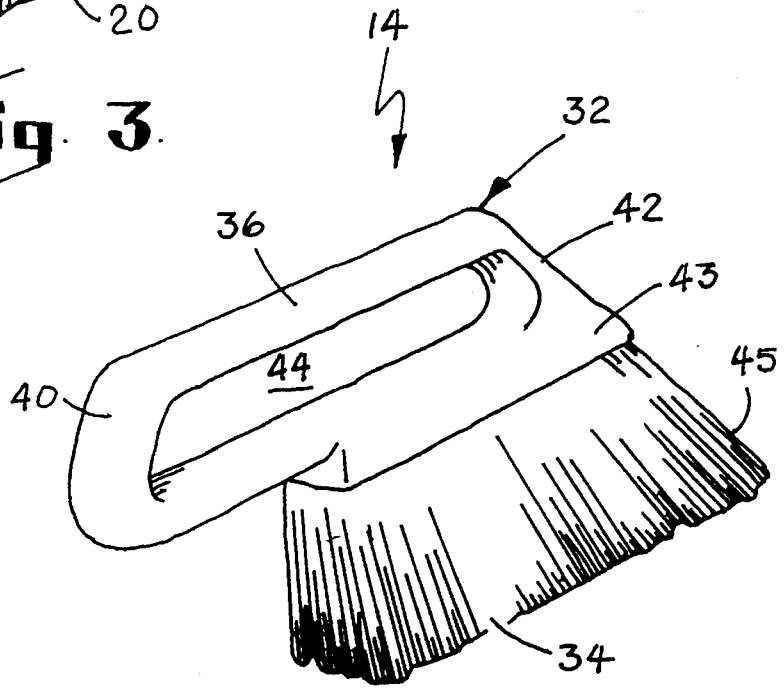
FIG. 4 is a perspective view of a second portion of the present invention.

Referring to FIGS. 1 and 4, second portion 14 consists of a support member indicated generally by reference numeral 32. In the preferred embodiment, support member 32 is formed of plastic and comprises a closed loop consisting of upper portion 36, lower portion 38, and side portions 40 and 42. These portions form an open central area 44 for a purpose which will become more clear hereinafter.

Lower portion 38 includes support portion 43 from which downwardly extends a cleaning element such as broom bristles 34 which again can be of conventional composition. The outer portion 45 of bristles 34 are preferably extended at a greater angle than normal, to permit the bristles 34 of second portion 14 to easily get under certain furniture obstacles while in use.

Upper and lower portions 36 and 38 are preferably of the same size, shape and have the same outer curvatures so that they readily fit within top and bottom portions 22 and 24 of first portion 12.

In other words, second portion 14 is removably secured within first portion 12 by means of support member 32 being slidably moveable within base member 18. Support member 32 may be friction fit within base member 18, or detents (not shown) or other mechanical contrivance may be used to secure the parts together while allowing them to be readily separated by a user.

The similarity in sizing between top and bottom portions 22 and 24 and upper and lower portions 36 and 38 permit support member 32 to be inserted into base member 18 in one of two alternate positions.

The first position is the conventional position illustrated in FIG. 1 whereby bristle portions 20 and 34 are juxtaposed adjacent to one another and extend in generally the same direction. In this conventional position, broom 10 may be used as a conventional broom.

Figure 5:
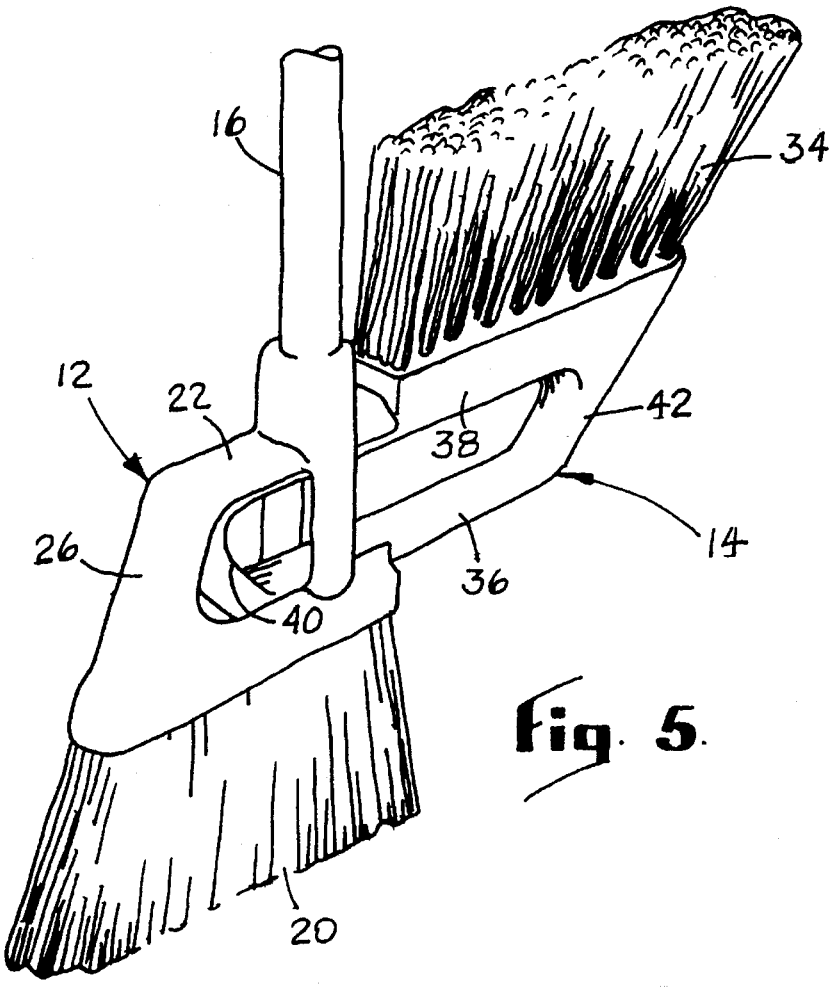
FIG. 5 is a perspective view of the preferred embodiment of the present invention utilized in an alternate mode.

The second position is illustrated in FIG. 5 and is achieved when second portion 14 is inserted "upside down" into first portion 12. In the inverted position illustrated in FIG. 5, bristle portions 20 and 34 are not juxtaposed; bristles 34 of second portion 14 extend in a 180 degree opposite direction to that of the first set of bristles 20 from first portion 12.

Figure 6:
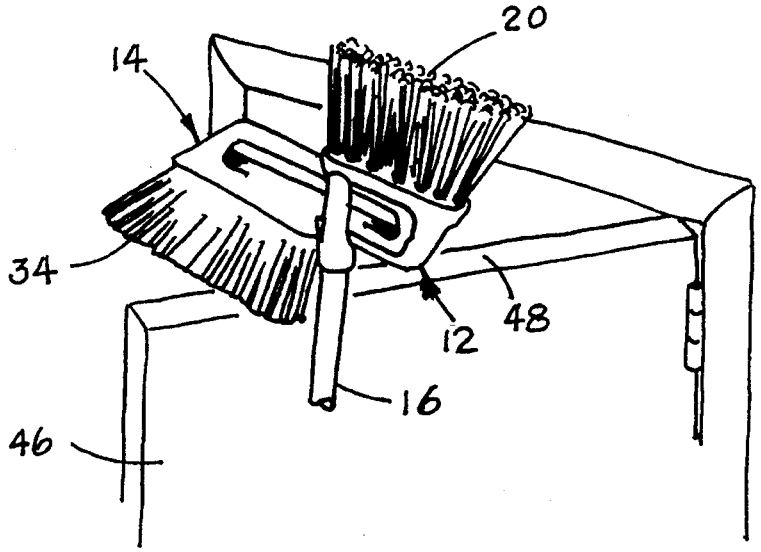
FIG. 6 illustrates the use of the alternate mode of the present invention.

The position of the first and second portions illustrated in FIG. 5, called the "inverted position", is very useful in cleaning normally inaccessible horizontal surfaces, such as the top surfaces of ceiling fan blades, the upper surfaces of doors, and the like. For example, illustrated in FIG. 6 is a door 46 having a normally inaccessible upper surface 48 onto which quite a bit of dust and dirt may accumulate. It may be appreciated that the bristles 34 of second portion 14 are in an excellent position to clean upper horizontal surface 48 when the second portion 14 is mounted in its inverted position (FIG. 5) and the user extends the handle 16 as shown.

In a still further alternate mode of operation, the second portion 14 may be used totally independently of first portion 12 as a hand-held sweeper illustrated in FIG. 4. The use of second portion 14 as a hand-held sweeper is schematically shown in FIG. 7 whereby a user may grip the open central area 44 and use portion 14 to dust or otherwise sweep off a surface either with or without an auxiliary dustpan (not shown).

Figure 7:
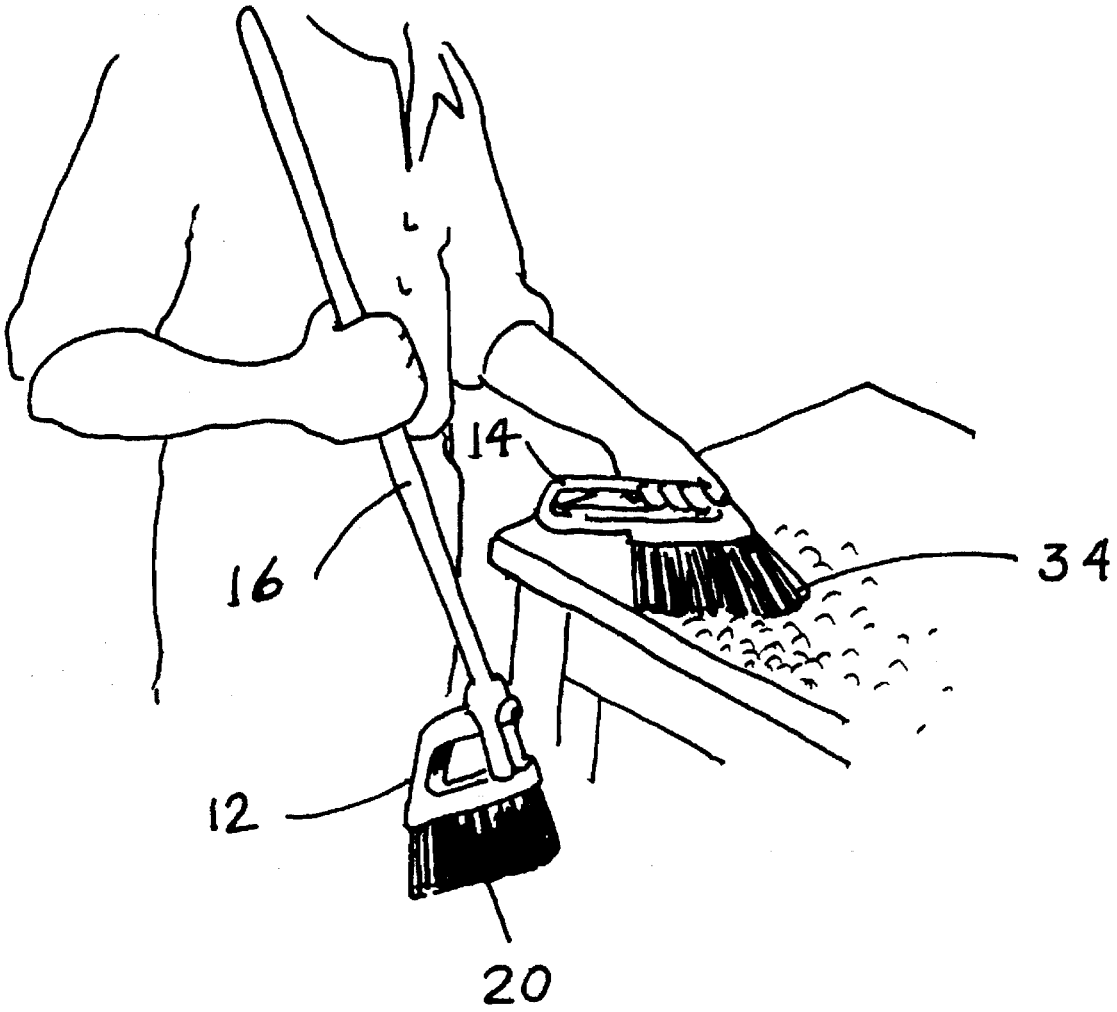
FIG. 7 illustrates how the second portion of the present invention may be used in yet another alternate mode.

It may be appreciated, therefore, that the present invention may be used in any of three different and distinct modes of operation: first, as a conventional broom (FIG. 1); second, in the inverted configuration illustrated in FIGS. 5 and 6 to clean hard-to-reach horizontal surfaces; and third, by using the second portion 14 as a separate and independent hand-held sweeper as illustrated in FIGS. 4 and 7.

It is clear that the manner and mode of attachment between the first and second portions 12 and 14 may be varied, and that the particular mode illustrated is only a preferred embodiment. Obviously, numerous modifications and variations of the present invention are possible in light of the above teachings. It is therefore to be understood that within the scope of the appended claims the invention may by practiced otherwise than as specifically described herein.

I claim as my invention:

1. A broom, which comprises:

a first portion comprising a first base member and a first set of bristles extending generally in a first direction from said first base member;

second portion comprising a second base member and a second set of bristles extending from said second base member;

an elongated broom handle connected to and extending from said first base member in a second direction which is generally opposite to said first direction;

said second portion being selectively attachable to and removable from said first portion;

wherein said second base member includes a hand grip portion to permit said second portion to be used as a hand sweeper, independently of said first portion; and wherein said hand grip portion comprises an upper portion, a lower portion, and a side portion connecting said upper portion and said lower portion, said upper, lower and side portions combining to form an opening to permit a user to grip same.

2. A broom, which comprises:

a first portion comprising a first base member and a first set of bristles extending from said first base member;

second portion comprising a second base member and a second set of bristles extending from said second base member;

a handle connected to said first base member;

said second portion being selectively attachable to and removable from said first portion;

wherein said second base member includes a hand grip portion to permit said second portion to be used as a hand sweeper, independently of said first portion;

wherein said hand grip portion comprises an upper portion, a lower portion, and a side portion connecting said upper portion and said lower portion, said upper, lower and side portions combining to form an opening to permit a user to grip same;

wherein said hand grip portion further comprises a second side portion connecting said upper portion and said lower portion, whereby said opening is a closed loop.

3. A broom, which comprises;

a first portion comprising a first base member and a first set of bristles extending generally in a first direction from said first base member;

a second portion comprising a second base member and a second set of bristles extending from said second base member;

an elongated broom handle connected to and extending from said first base member in a second direction which is generally opposite to said first direction;

said second portion being selectively attachable to and removable from said first portion; and wherein said first portion and said second portion further include coupling means for permitting said second portion to be mounted to said first portion in either a conventional position wherein both of said first and second set of bristles extend generally in said first direction or an inverted position wherein said first set of bristles extend generally in said first direction and said second set of bristles extend generally in said second direction.

4. A broom as set forth in claim 3, wherein said conventional position is further defined by said first and second set of bristles being adjacent one another.

5. A broom as set forth in claim 3, wherein said coupling means comprises means formed in said first and second base members for permitting said second base member to be slidably inserted in and removed from said first base member.

6. A broom, which comprises:

a first portion having a first set of bristles extending therefrom in a first direction;

a second portion having a second set of bristles extending therefrom;

an elongated broom handle connected to and extending from said first portion in a second direction which is generally opposite to said first direction;

said second portion being selectively attachable to said first portion in either a conventional position wherein both of said first and second set of bristles extend generally in said first direction or an inverted position wherein said first set of bristles extend generally in said first direction and said second set of bristles extend generally in said second direction.

7. A broom as set forth in claim 6, wherein said conventional position is further defined by said first and second set of bristles being adjacent one another.

8. A broom as set forth in claim 6, wherein said first and second portions include coupling means for permitting said second portion to be slidably inserted in and removed from said first portion.

9. A broom as set forth in claim 6, wherein said second portion includes a hand grip portion to permit said second portion to be removed from said first portion and used as a hand sweeper, independently of said first portion.

* * * * *